US010867503B1

(12) United States Patent
Hupps et al.

(10) Patent No.: US 10,867,503 B1
(45) Date of Patent: Dec. 15, 2020

(54) LASER MONITORING SYSTEM

(71) Applicants: Brian Hupps, Port St. Lucie, FL (US); Jason A. Eulette, Doral, FL (US)

(72) Inventors: Brian Hupps, Port St. Lucie, FL (US); Jason A. Eulette, Doral, FL (US)

( * ) Notice: Subject to any disclaimer, the term of this patent is extended or adjusted under 35 U.S.C. 154(b) by 0 days.

(21) Appl. No.: 16/430,557

(22) Filed: Jun. 4, 2019

Related U.S. Application Data

(60) Provisional application No. 62/680,741, filed on Jun. 5, 2018.

(51) Int. Cl.
*G08B 21/04* (2006.01)
*G08B 29/18* (2006.01)

(52) U.S. Cl.
CPC ..... *G08B 21/0461* (2013.01); *G08B 29/185* (2013.01)

(58) Field of Classification Search
CPC ..... G08B 21/0461; G08B 29/185
USPC ..... 340/501
See application file for complete search history.

(56) References Cited

U.S. PATENT DOCUMENTS 10,205,913 B2 * 2/2019 Smith ..... H04N 5/23206
10,729,024 B2 * 7/2020 Moritz ..... F21V 33/0076
2008/0021731 A1 * 1/2008 Rodgers ..... A61B 5/1113 705/2
2013/0172691 A1 * 7/2013 Tran ..... A61B 8/06 600/301
2015/0035677 A1 * 2/2015 Williams ..... G08B 21/22 340/573.1
2020/0077892 A1 * 3/2020 Tran ..... A61B 5/6824
2020/0077925 A1 * 3/2020 Ovalle ..... A61B 5/002

* cited by examiner

*Primary Examiner* — Hirdepal Singh
(74) *Attorney, Agent, or Firm* — Colls Consulting, LLC

(57) ABSTRACT

A laser monitoring system designed to prevent accidental falls of people who are at high risk of falling when they try to get up from a chair, commode, or bed. The system includes a first unit providing a circuit board, a laser emitting device, an alignment indicator, a control button, a communicator, an alarm speaker, an electrical port, and an electrical housing that retains all of the above. The system also includes a second unit providing a circuit board, a laser receiving device, an alignment indicator, and receiver which are all retained inside of an electrical housing. The first unit and second unit form a laser net alarm system that when interrupted provides an audible alarm requesting that the patient wait for medical attention, while at the same time may notify the care giver that their patient is trying to get up unassisted by sending an electronic message to the care giver's electronic device.

18 Claims, 13 Drawing Sheets

LASER MONITORING SYSTEM

CROSS-REFERENCE TO RELATED APPLICATIONS

This U.S. Nonprovisional patent application claims the benefit of U.S. Provisional patent application Ser. No. 62/680,741, having a filing date of Jun. 5, 2018, which is incorporated herein in its entirety.

FIELD OF THE INVENTION

The present invention relates generally to monitoring systems, and more particularly, to a laser monitoring system that can be used to prevent accidental falls of patients that are left unattended. The laser monitoring system is designed to alert a care giver that a patient is trying to get up unattended, and may include an electronic messaging alert feature that sends an electronic message to the care giver via a wireless network notifying them that the patient is getting up unattended.

BACKGROUND OF THE INVENTION

For the first time in history, people of all classes around the world are likely to live to 60 years of age or beyond. Longevity is one of the greatest achievements of our modern era, and called by the United Nations as one of the most significant social transformations of the 21$^{st}$ century. Our success in achieving longevity, however, is ironically short lived by the compromised quality of life many people live plagued with poor health and the loss of autonomy. For instance, there are an increased number of people who develop degenerative brain diseases, such as, dementia, Alzheimer, and Parkinson because they are outliving their mind's functional ability.

This translates to a large number of people being hospitalized each year, which creates an entire new set of problems and a major concern for health care organizations as they try and focus on patient care. A particular focus by health organizations is on preventing falls. Unfortunately, patients who suffer from a brain degenerative disease have a high propensity of falling because they try and get up while they are confused or disoriented. According to the Center for Disease Control (CDC), falls are the leading cause of hospital acquired injuries and are estimated to directly cost hospitals approximately $31 billion annually.

Although a hospital's nursing staff, homes care givers, and other health care organizations staff continuously strive to provide the best care for their patients, they are unable to remain at the beside of every patient who is at a high risk of falling. Accordingly, facilities have turn to alert mechanisms that alert them if a patient is about to have a fall. Some of these alert mechanisms include a pressure pad system. This type of system, however, is heavily flawed. In order for the system to alert the nurse or care giver that the patient is getting up, the patient must completely come off the pad. By the time the patient is completely off of the pad, the patient is already at serious risk of falling, or worse, already fallen.

Another type of monitoring system includes a device that has a string attached to a clip that is attached to the patients clothing or gown. When the patient moves and the string tenses the system alerts a health care professional that the patient is trying to get up. However, a mayor disadvantage is that the patient can easily remove the clip attached to their clothing before getting up.

Alternative preventative fall apparatuses include physical restraints that confine a patient to a bed or chair. This approach, however, puts the patient at risk of other types of injuries that may include psychological harm. Pharmaceutical restraints put the patient in a drowsy state that prevents them from moving. Although this approach is somewhat effective, once the effects of the medication ware off the patient is once again at risk of falling. Not to mention the adverse effects of being medicated for long periods of time.

Accordingly, there is an established need for a monitoring system that uses a laser system that triggers an audible and electronic messaging alarm to alert a care giver that a patient is getting up unattended.

SUMMARY OF THE INVENTION

The present invention is directed to a laser monitoring system that can be used in hospitals, nursing homes, personal homes, or the like, to help prevent accidental falls. The system is designed to trigger audible alarms to alert a care giver that a patient is about to get up unattended.

Introducing a first embodiment of the invention, a laser monitoring system, comprising: a first unit, a second unit, and a universal mount affixed to the first unit and the second unit. The universal mount attachable to a mounting arm, wherein the first unit and the second unit are selectively linked to one another to provide a penetrable laser net alarm.

In another aspect, the first unit comprises, a circuit board, a laser emitting device, a first alignment indicator, at least two control buttons, an alarm speaker, at least one communication port. The communication port may be connected to a connection line to selectively link the first unit to the second unit. An electrical port for receiving an electrical connector to energize the first unit may be provided. And, an electrical housing having an internal space for retaining the circuit board, the laser emitting device, the first alignment indicator, the at least one control button, the at least one communication port, the electrical port, and the alarm speaker is provided.

In yet another aspect, the second unit comprises, a circuit board, a laser receiving device, a second alignment indicator, at least one receiving port, and an electrical housing to retain the circuit board, laser receiving device, indicator, and port.

In another aspect, the laser emitting device may comprise of, at least one alignment laser, at least one activation laser, and at least one alarm laser.

In a another aspect, the laser receiving device may comprise of, at least one laser alignment sensor, at least one laser activation sensor, and at least one laser alarm sensor.

In yet another aspect, the second alignment indicator of the second unit may include at least one LED light that indicates proper alignment and improper alignment of the second unit with the first unit.

In yet another aspect, the first alignment indicator of the first unit includes at least one LED light that indicates proper alignment and improper alignment of the first unit with the second unit.

In another aspect, an audible alarm may be played from the alarm speaker when the penetrable laser net alarm is interrupted and subsequently uninterrupted by a person.

In still another aspect, the audible alarm may be a pre-recorded message of someone known requesting a patient to remain seated until help arrives In still another aspect, the first unit and second unit may be attached to a commode, chair, bed, or the like.

In yet another aspect, the second unit further comprises an internal timer to prevent false alarms the penetrable laser emitted from the system is interrupted accidently.

In yet another aspect, the first unit and second unit are communicable with a wireless device via a wireless network.

In yet another aspect, the alarm provided by the system may be triggered when the laser provided by the system is interrupted and subsequently uninterrupted by a person for a pre-set duration of time.

In yet another aspect, the set duration of time may be a time range of approximately 2-7 seconds.

In another aspect, the alarm may include a generic audible alarm message requesting that the patient remain seated until help arrives.

In another aspect, the alarm may include and an electronic message that is sent wirelessly via a wireless network to an electronic device carried by the care giver notifying them that their patient is about to get up unattended.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
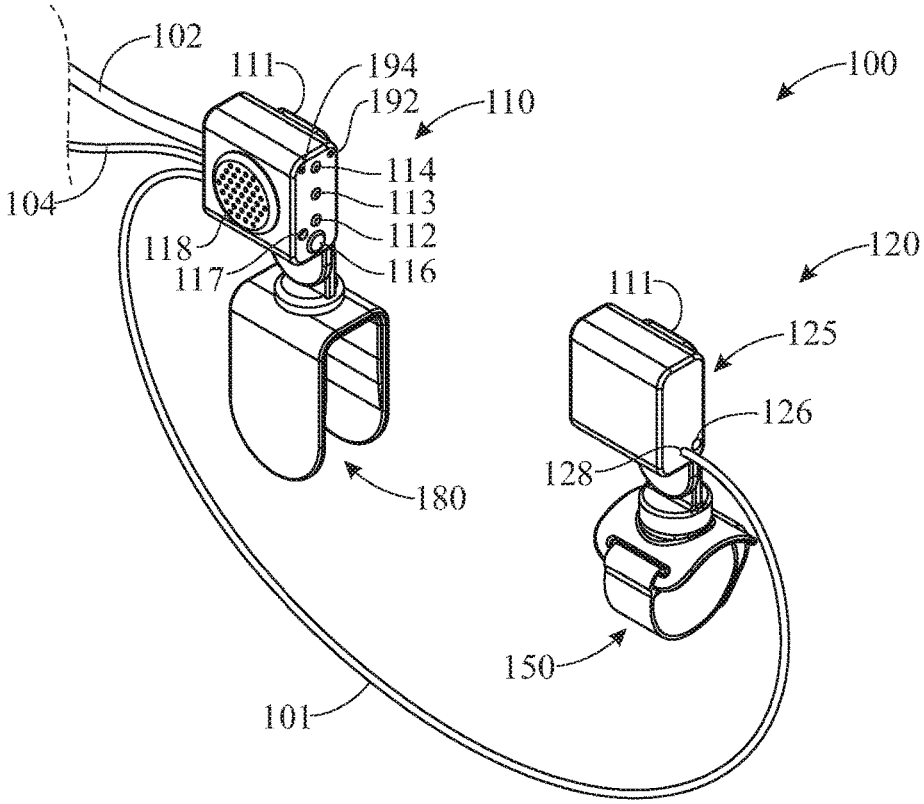
FIG. 1 presents a front isometric view of a first embodiment of a laser alert system.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-15, and initially to FIGS. 1-4, a laser monitoring system 100 is illustrated in accordance with an exemplary embodiment of the present invention. The laser monitoring system 100 generally includes a first unit 110 (hereinafter referred to as an emitting unit) and a second unit 120 (hereinafter referred to as a receiving unit). The emitting unit 110 and receiving unit 120 are connected by a cable 101, allowing each unit to communicate to each other. Cable 101 connects to port 103 on the emitting unit 110 and to port 128 on the receiving unit 120. It is contemplated that unit 120 include and be equipped with an additional connecting port 126 in the event an additional unit is needed. Unit 120 may also include an electrical housing 108 that provides the unit's circuit board, laser emitters, led lights, ports, control buttons, and alarm speaker.

Figure 15:
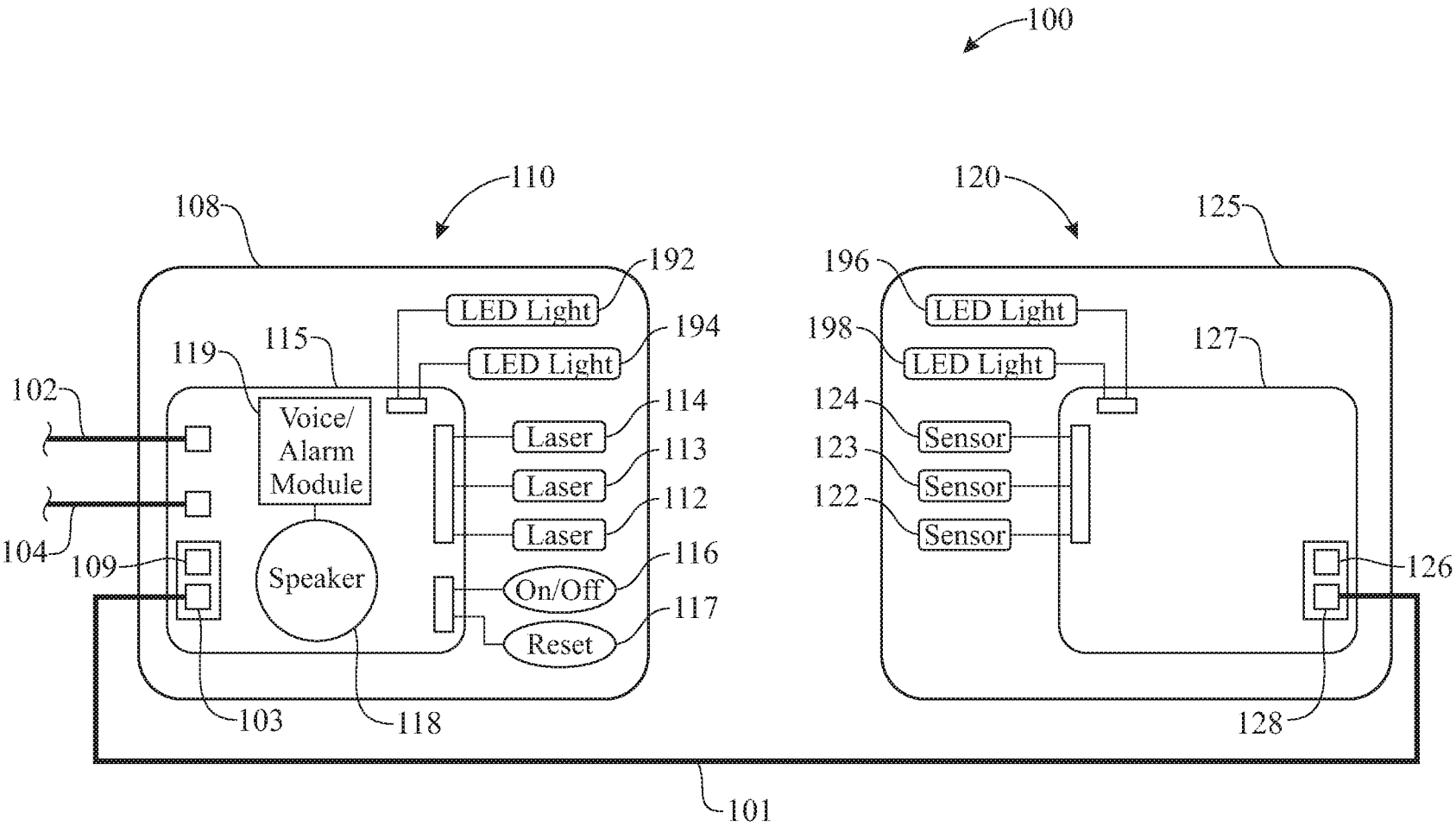
FIG. 15 presents a logic schematic.

Moving specifically to FIGS. 1 and 15, unit 110 may include at least 3 emitting lasers; one laser 112 may be provided for the purpose of alignment, a second laser 113 may be utilized for the activation of the unit, and the third laser 114 may be used to trigger an alarm. The unit 110 may also include LED lights 192, 194 that function as alignment indicators, where LED light 192 indicates an error (if the units are unaligned), and LED light 194 indicates that the units are properly aligned. Unit 110 may also include a speaker 118 that can be used to broadcast a voice or sound alarm when the alarm is triggered.

Figure 2:
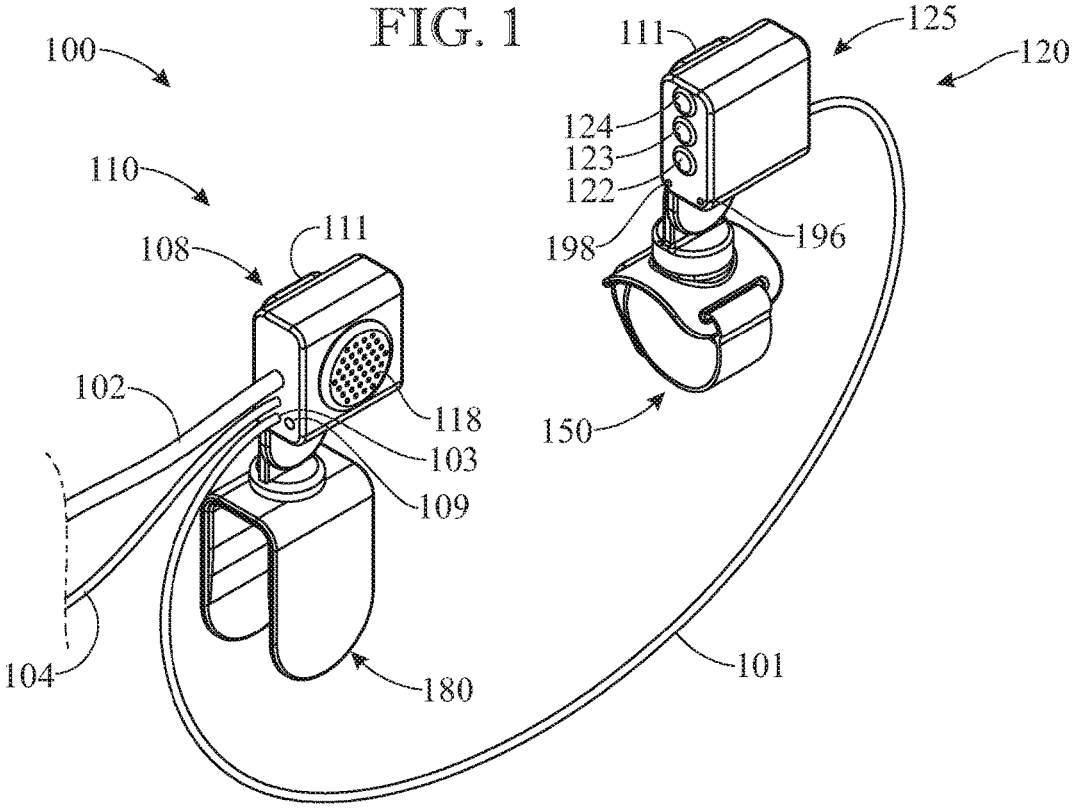
FIG. 2 presents a rear isometric view of the laser alert system originally shown in FIG. 1.

As is best illustrated in FIGS. 2 and 15, the receiving unit 120 may include a circuit board 127, laser sensors, led lights, and ports all stored within housing 125. Unit 120 may further include at least 3 laser sensors; one laser sensor 122 may be utilized for alignment, a second laser sensor 123 may be used for activation purposes, and a third laser sensor 124 may be used to trigger an alarm. The voice alarm broadcasted by the speaker 118 may include a voice recorded message that has been pre-recorded by one of the patient's family member requesting the patient stay in bed, and wait for a healthcare professional to help them. Alternatively, the alarm may include a generic voice recording that requests the patient wait for a healthcare professional to come help them. As seen in the accompanying drawings, the unit 120 may also include LED lights that may be used as alignment indicators. For example, LED light 198 may be used to indicate an error (or improper alignment), and light 196 may be used to indicate proper alignment. Similar to unit 110, unit 120 may also include an additional port 109 to selectively add an additional sensor. The system 100 may also include a timer that is incorporated into the coding of the system's circuit board, and may be utilized to prevent the triggering of a false alarm by someone waving a foreign object in front of the alarm laser 107, for example, a hand, or moving a toilet seat up and down, etc. It should also be readily understood by one of ordinary skill in the art that additional emitting lasers and sensors may be added to units 110 and 120.

Figure 4:
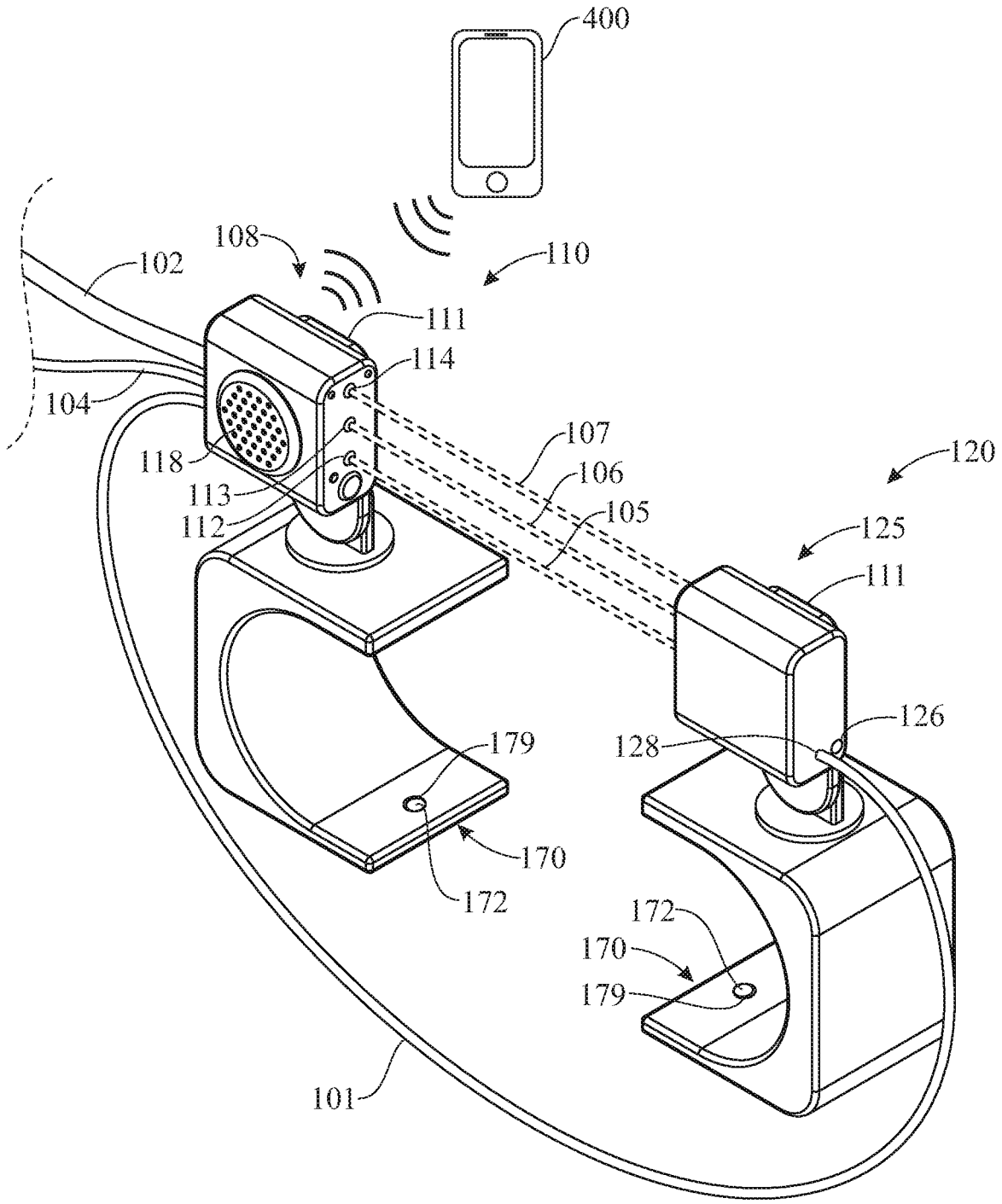
FIG. 4 presents an isometric view of the laser alert system shown in FIG. 1, being selectively attached to a C-mount bracket.
Figure 12:
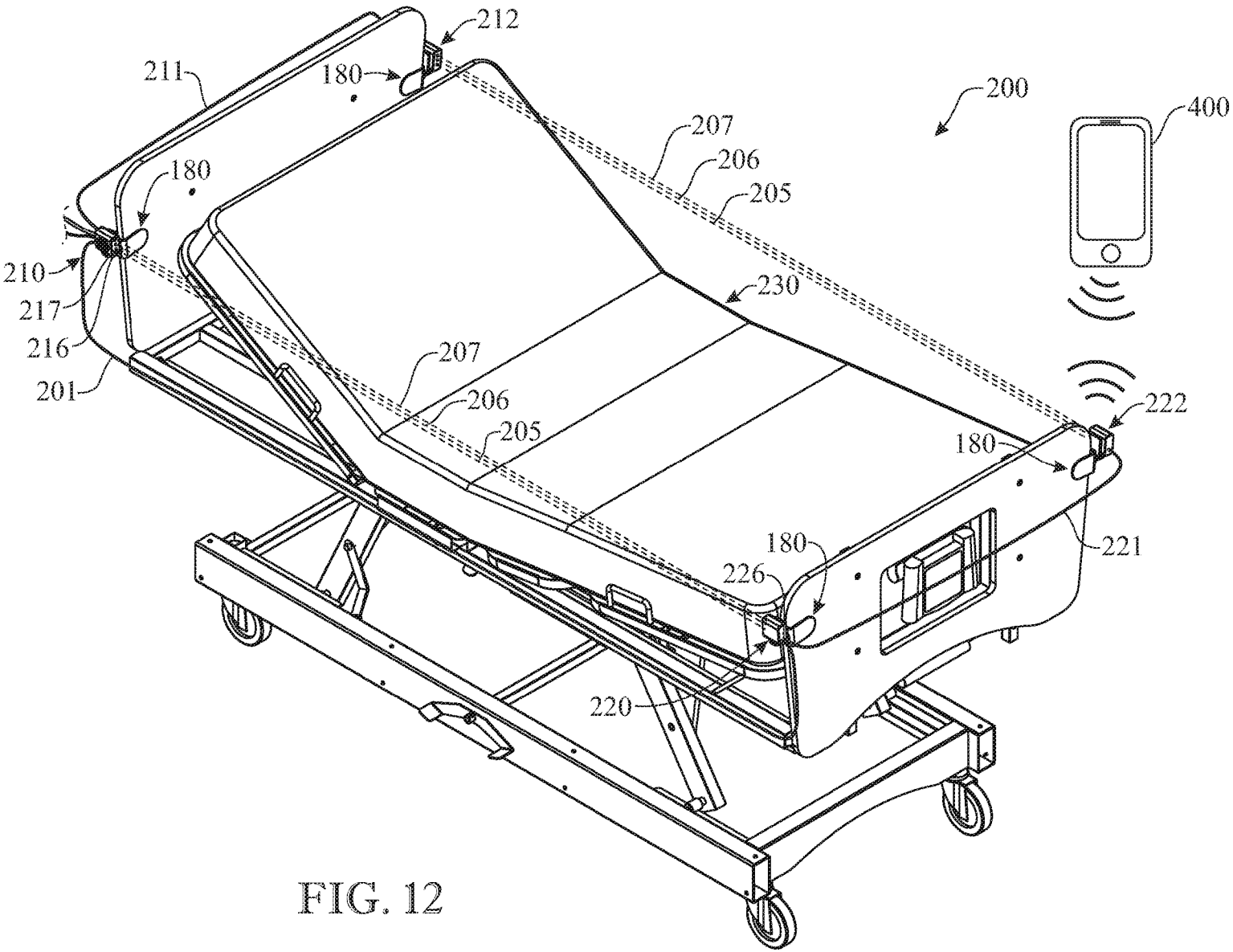
FIG. 12 presents a front isometric view of the laser alert system originally shown in FIG. 1, being selectively mounted to a hospital bed at the foot and head of the bed.

Turning now to FIGS. 1, 4 and 15, the system 100 may include at least two control buttons on unit 110. One button being an On/Off switch 116, which controls the power to the unit, and a second button that may function as a reset button 117, which delays and/or resets the laser emitters and alarm. The On/Off switch 116 provided on the unit 110 may include a safety feature that prevents accidental, or in some instances an intentional act, to turn off the system 100. For example, the unit 100 may require a combination of buttons be pressed simultaneously as the On/Off switch in order shut off. Of course, it should be readily understood by those skilled in the art that additional controlled features may be added to the unit. For instance, the unit may include a Bluetooth link button that allows the unit to sync to a mobile device or the like. Or, the system 100 may have the capacity to connect to a wife network 402 that permits connection to the care givers a mobile device 400 (as illustrated in FIG. 12). Once the system and electronic device 400 are in sync, a message may be sent from the unit to the mobile device 400, tablet, pager, or smart watch, notifying the care giver that the patient is trying to get up. For example, the message sent could be in the form of a text message or automated call. Unit 110 may also include a power supply cord 104 that connects and energizes the electrical contents inside of housing 108. Although it is not shown in the accompanying figures, it is contemplated that system 100 include a communication cable 102 that feeds from housing 108 and connects to an existing communication systems provided by the health care provided, thereby syncing both systems to work in tandem. It also contemplated that the unit be able to run on reserve power should it be accidently disconnected, and produce a loud audible sound notifying the care giver that the unit is disconnected and running low on power.

Figure 3:
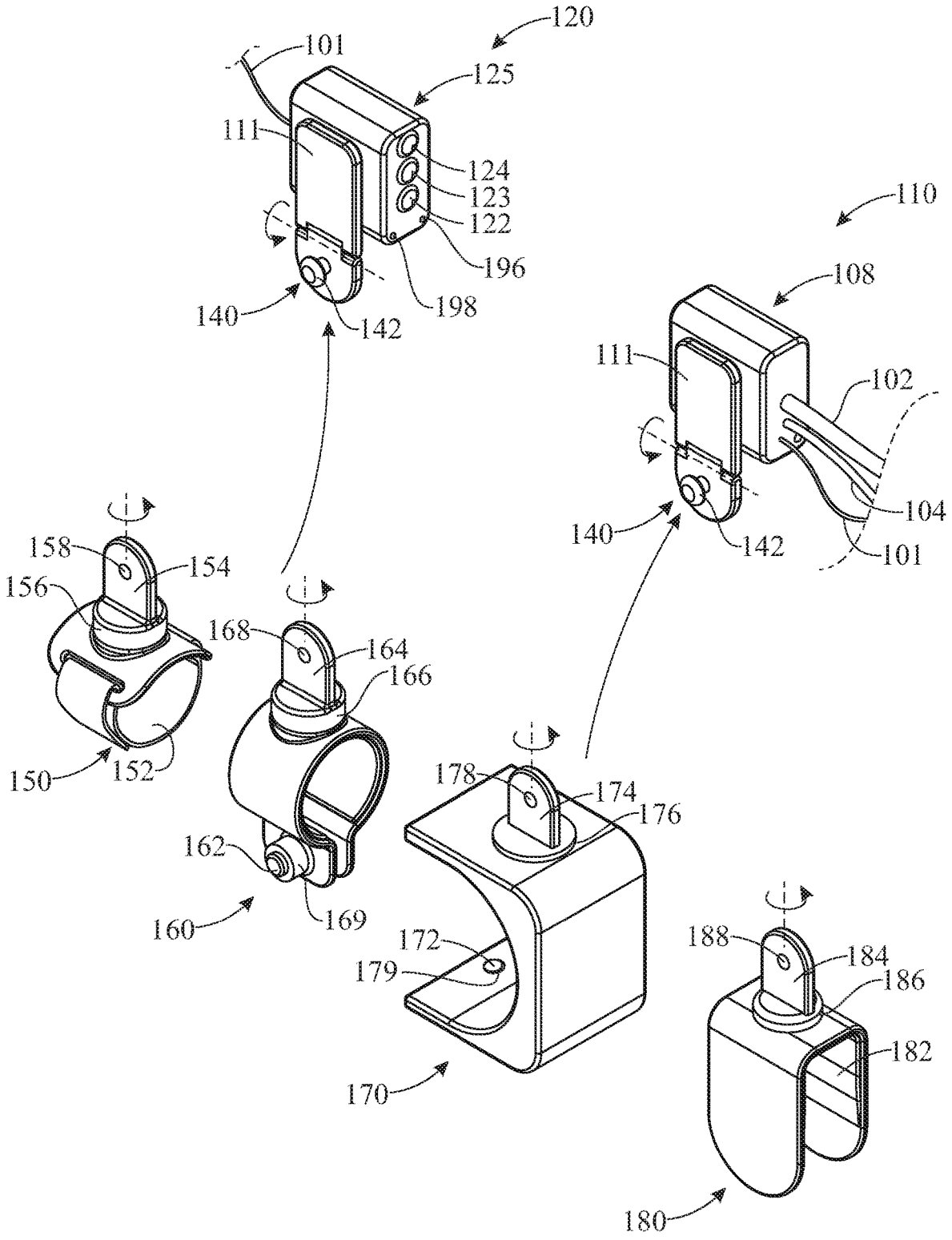
FIG. 3 presents an isometric view of the laser alert system shown in FIG. 1, being selectively attachable to a plurality of mounting attachments.

Referring now to FIG. 3, the emitting unit 110 and the receiving unit 120 can both be selectively attached to a universal mount 140. The mount 140 includes a support member 111 that may be selectively attached to a swivel arm 140 that includes a notch 142. The universal mount 140 can subsequently be selectively attached to a plurality of additional mounts. For example, as shown in FIG. 3, universal mount 140 can be attached to a swivel strap attachment 150. The swivel strap attachment may include a mounting tab 154, a mounting hole 158 that engages notch 142, a swivel cap 156, and a hook and loop strap 152. In another example, the universal mount 140 may be mounted to a different type of mount, such as, a swivel clamp 160. The swivel clamp 160 may include a mounting tab 164, a mounting hole 168 that engages notch 142, a swivel cap 166, and a nut 169 and clamp screw 162. In yet another example, universal mount 140 may be selectively coupled to a swivel C-mount 170. The C-mount, which is also shown in FIG. 3, may include a mounting tab 174, a mounting hole that engages notch 142, a swivel cap 176, a clamp screw 172, and a threaded hole 179. And, finally, in still another example, universal mount 140 may be selectively coupled to a swivel U-mount attachment 180. The U-mount attachment 180 may include a mounting tab 184, a mounting hole 188, a swivel cap 186, and a compressible material lining 182 on the inner surface of the u-shaped channel on the U-mount 180. Of course, it should be readily understood that universal mount 140 may be selectively attached to additional mounts that are not provided in the accompanying figures, and, as such, said mounts described heretofore should not be considered limiting.

The mounting of units 110 and 120 to an object (e.g., commode, toilet, chair or bed), and the alignment of said units is now discussed with reference to FIGS. 4-14.

Turning specifically to FIGS. 4-9, in accordance with one exemplary embodiment of the present invention, unit 110 and unit 120 is shown coupled to a swivel C-mount 170 via universal mount 140. This particular mount (i.e., swivel C-mount 170), may be utilized with objects that are difficult to attach to, and do not include features that the other type of mounts as have been described herein above may be coupled to. However, alternative mounts and combination of mounts may be utilized in instances where a more desirable mount is needed. For instance, the combination of a C-mount and a clamp mount may be utilized to achieve the present invention's objective. Therefore, the following description of the present invention being mounted to an object, toilet, commode, recliner, chair, bed, or the like, should not be construed as limiting, but exemplary.

Figure 5:
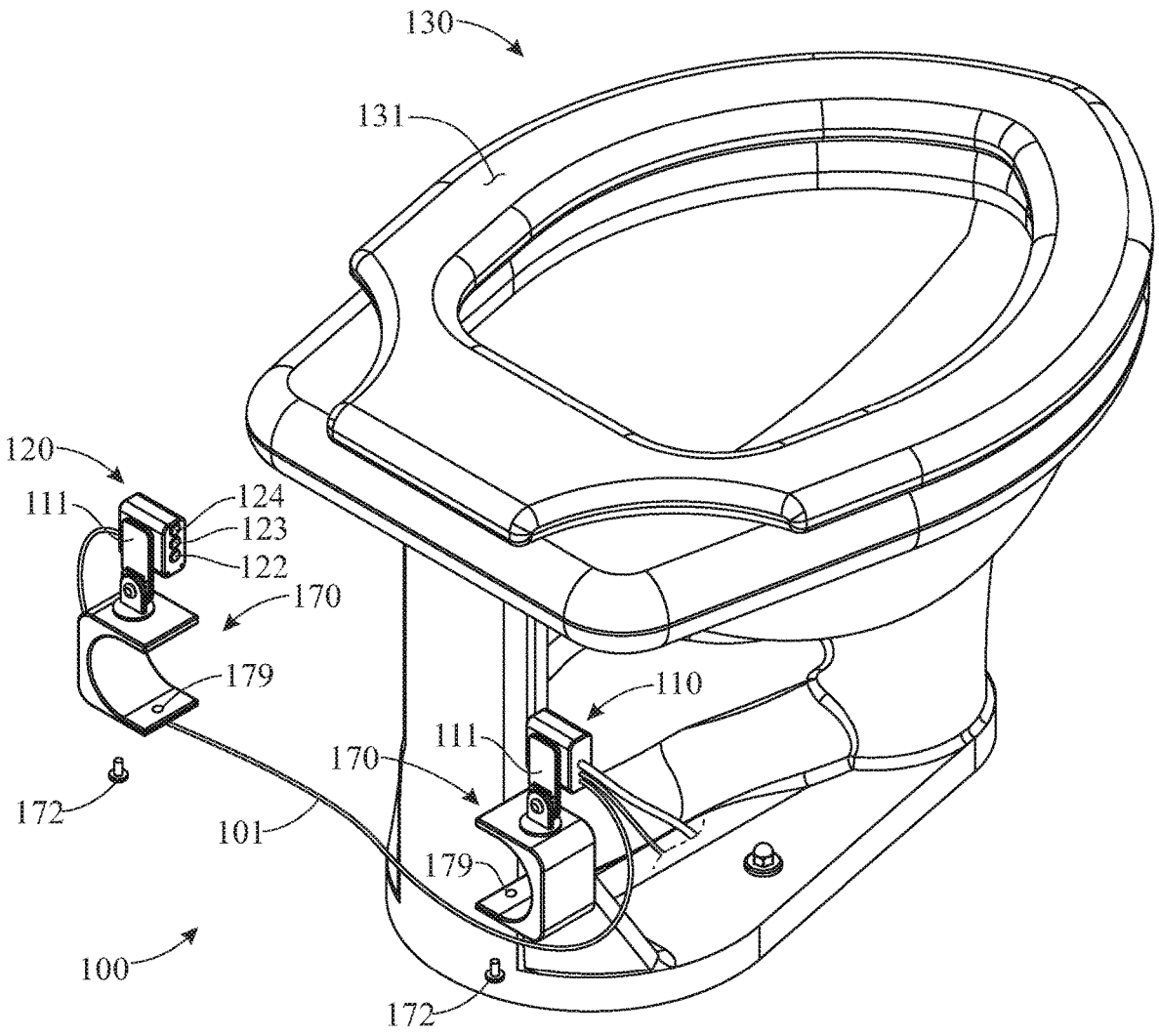
FIG. 5 presents a rear isometric view of the laser alert system shown in FIG. 4, just before it is selectively mounted to a toilet.
Figure 6:
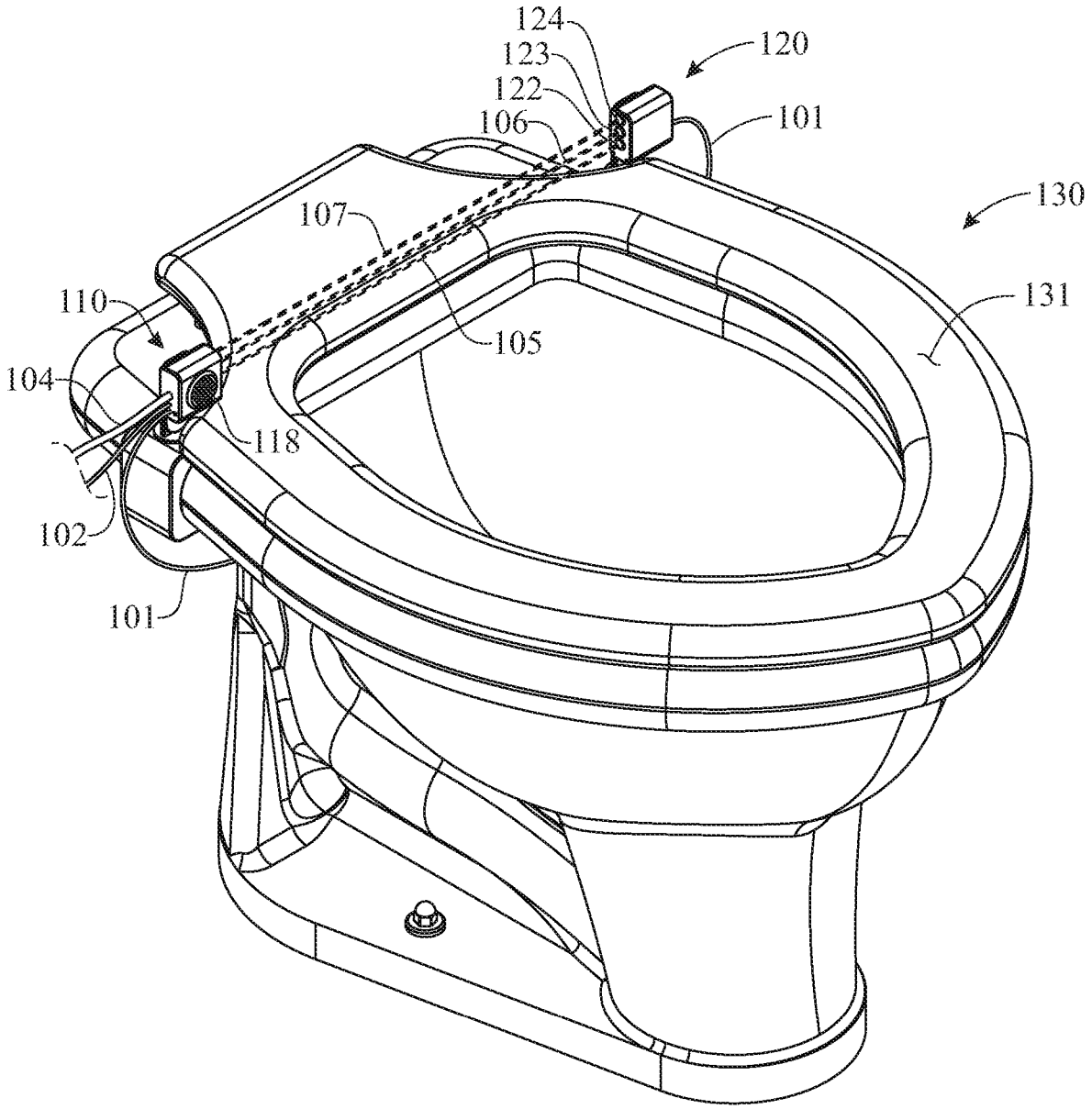
FIG. 6 presents a front isometric view of the laser alert system shown in FIG. 4, selectively mounted to a toilet.
Figure 7:
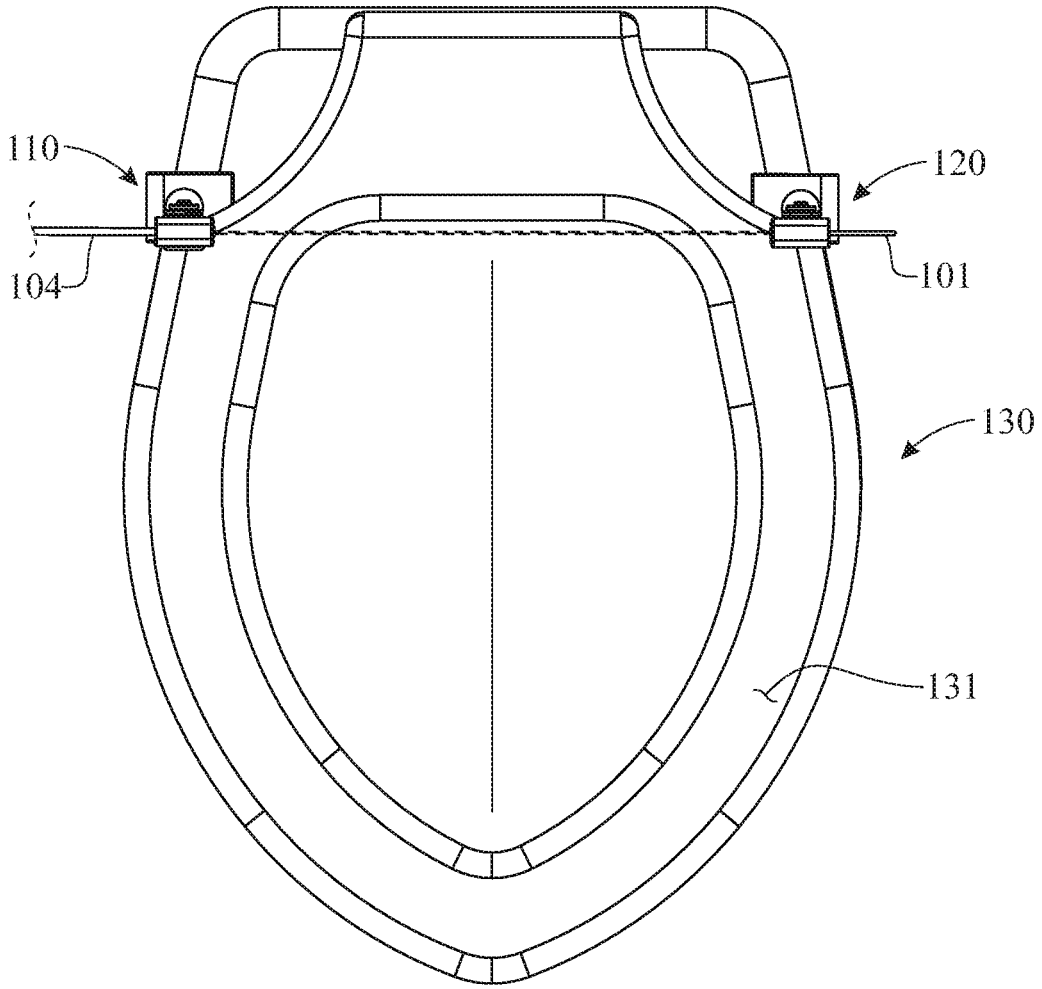
FIG. 7 presents a top view of the laser alert system mounted to the toilet.
Figure 8:
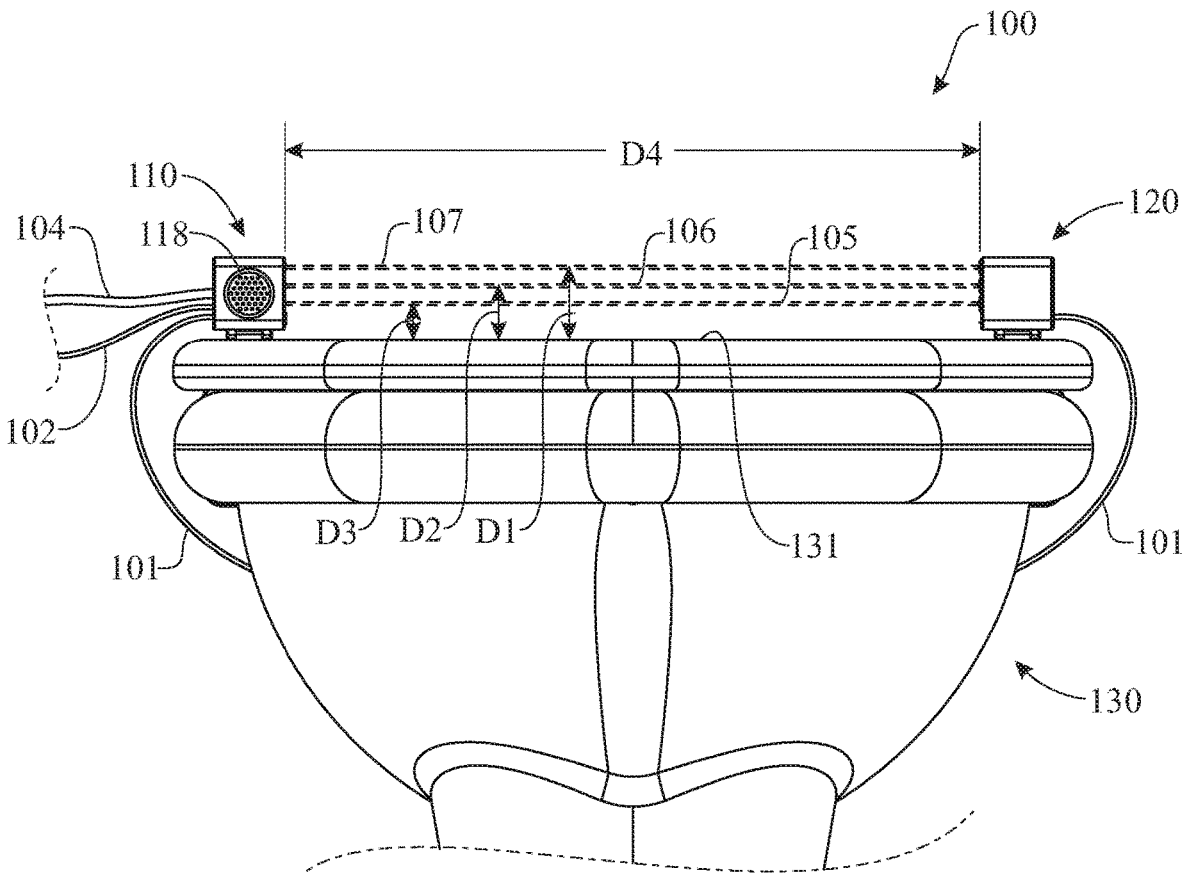
FIG. 8 presents a front view of the laser alert system mounted to the toilet with the C-mounting bracket originally shown in FIG. 4.
Figure 9:
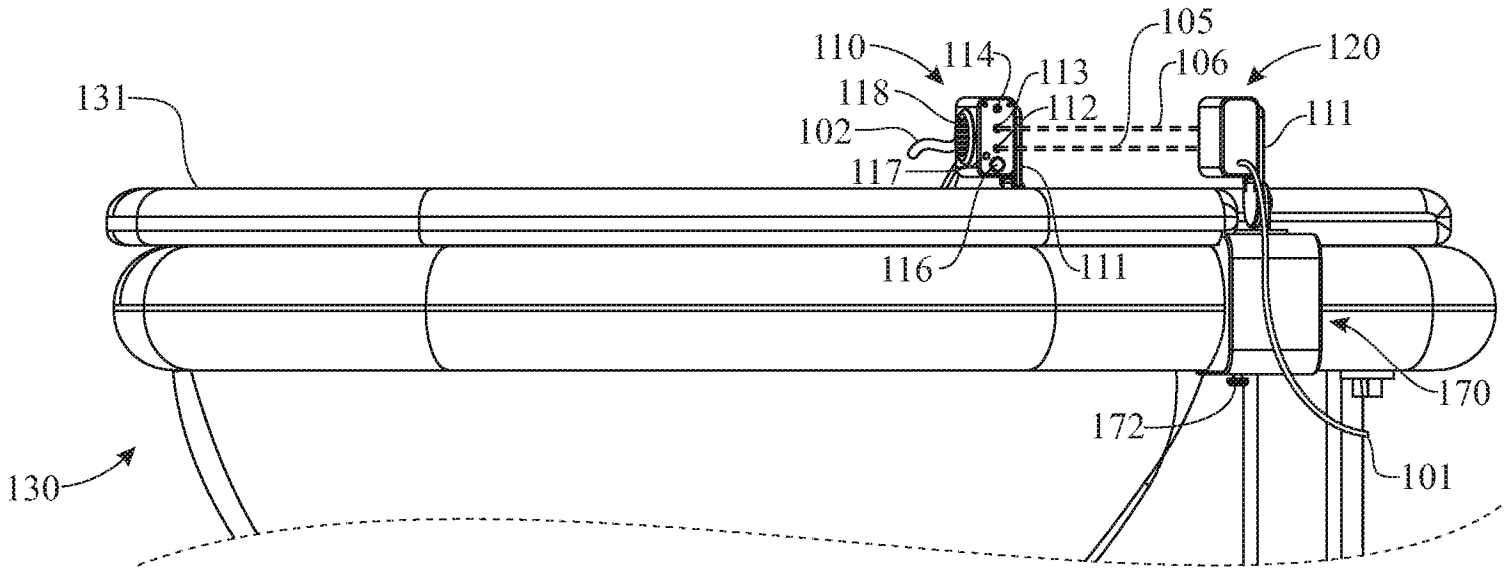
FIG. 9 presents a right side skewed view of the laser alert system.

As shown in FIG. 5, unit 110 and unit 120 may be selectively attached to the upper area of an object 130, which in this case is shown as a toilet with toilet seat 131 where a person would sit. After coupling unit 110 and unit 120 to object 130 with an appropriate mount (in this example being a C-mount), both faces of each unit are lined up in front of each other (i.e., with each side panel being parallel to one another, as clearly depicted in FIG. 8) a distance D4. The distance each unit is set up with respect to the other is adjustable, and may vary depending on the object the system is being coupled to. Once the units are aligned, the lasers being emitted from the emitting unit 110, such as, the alignment laser 105, the activation laser 106, and the alarm laser 107 make contact with each respective sensor. In other words, alignment laser 107 is received by alignment sensor 122, activation laser 106 is received by activation 123, and alarm laser 107 is received by alarm sensor 124. The alignment of the lasers can be best seen in FIG. 7. Once the lasers are aligned, and as illustrated in one exemplary embodiment of the present invention in FIG. 8, the lasers being emitted by the system 100 are projecting at different distances above the surface 131 of object 130. For example, D1 is measuring the vertical distance from surface 131 to the horizontal projection of alarm laser 107. D2 is measuring the vertical distance from the surface 131 to the horizontal projection of activation laser 106, and D3 is measuring the vertical distance from the surface 131 to the horizontal projection of alignment laser 105.

In the event the units are not aligned, LED light 198 will turn on indicating that the units are improperly aligned. In other words, the laser being emitted from unit 110 is not being properly received by unit 120. Once corrected, and the units are properly aligned, LED light 196 will turn on confirming proper alignment. It is also contemplated that the system create an auditory signal notifying the care giver that the units are properly or improperly aligned. For example, in the case that the unit is not properly aligned, a series of continuous auditory beeps will sound from speaker 118 letting the care giver know that the system is not ready. Once properly aligned the system may give a long beep to notify the care giver that the units are properly aligned. Furthermore, it is contemplated that the system be linked an electronic device, such as an ipad, iPhone, tablet, smart phone, smart watch, or the like, that includes a mobile device app that notifies the care giver that the system is properly or improperly aligned.

Although the units may be turned on and off via switch 116, for the sake of brevity, the remaining description provided herein below will be under the understanding that switch 116 is on the ON position. Continuing on FIGS. 6 and 8, once unit 110 and unit 120 have been properly coupled to an object 130, and are properly aligned confirmed by LED light 196 (i.e., the unit is ready to be used), the laser monitor system 100 is automatically activated. When initially activated, the system 100 is in a dormant state. In other words, all of the respective alignment, activation, and alarm lasers are properly being received by their respective alignment, activation, and alarm sensors. The system 100 will continue in a dormant state until the system is system is turned off by a care giver, or the lasers being emitted receive interference.

Figure 10:
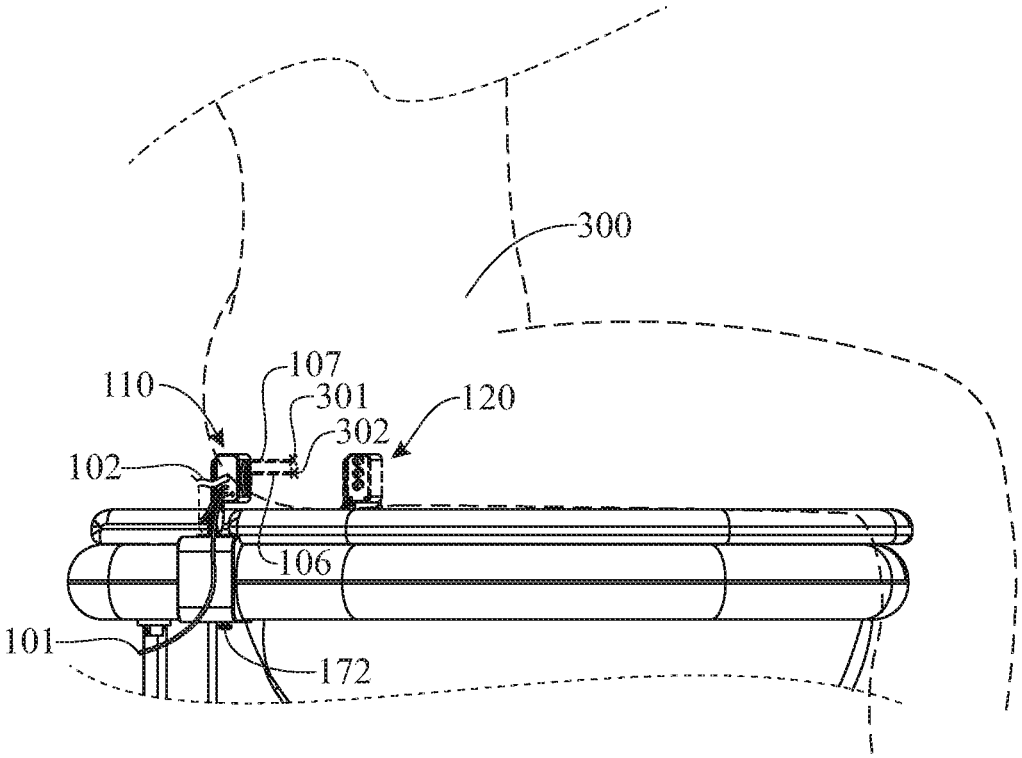
FIG. 10 presents a left side skewed view of the laser alert system mounted to the toilet in use.
Figure 11:
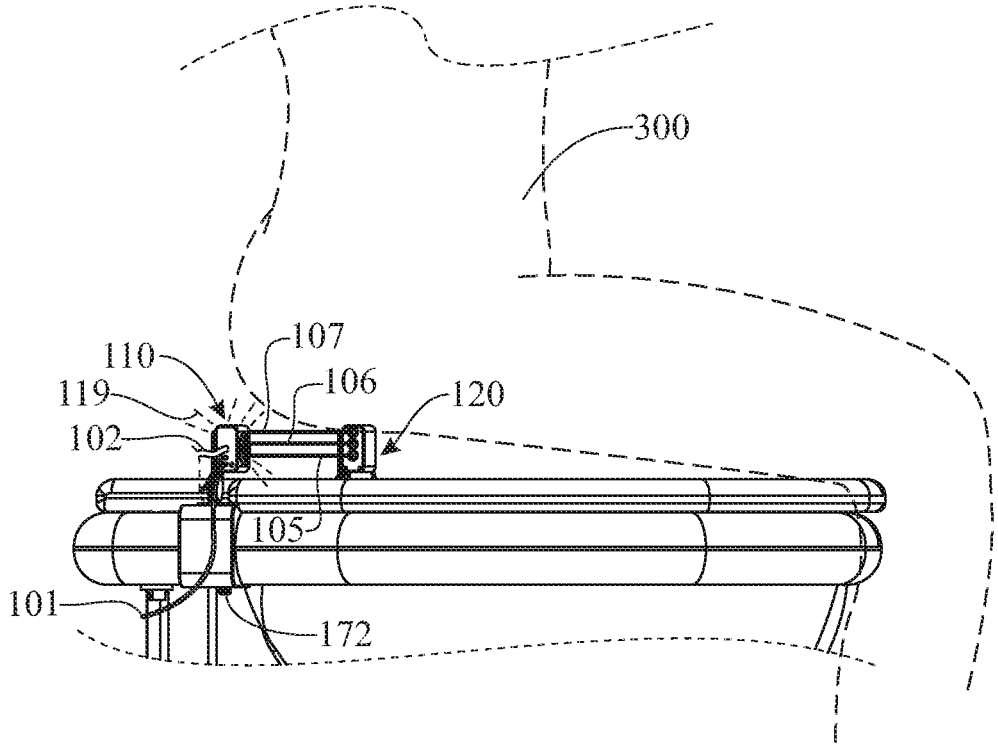
FIG. 11 presents a left side skewed view of the laser alert system mounted to the toilet in use.

For example, as illustrated in FIGS. 10 and 11, the system 100 remains dormant until a patient 300 interferes with the alarm laser 107 being emitted from unit 110. As soon as the laser 107 is broken for a pre-set amount of time clocked by a timer (i.e., there is a foreign object interfering the alarm laser from reaching the alarm sensor 124), the system immediately switches to a pre-alarm state. For example, the timer may be set for 3-5 seconds. Meaning, if the laser signal is interrupted for longer than the pre-set minimum, the system automatically changes from a dormant state to a pre-alarm state. After the system 100 has been properly armed and in a pre-alarm state, the system 100 is designed to activate as soon as the patient tries to get up and the alarm laser is once again received by its respective sensor. This triggers an audible alarm that may include a pre-recorded message by a loved one (or a generic recording) asking that the patient to sit back down and wait for help. If the patient sits back down and, once again, interferences between the alarm laser 107 and the alarm sensor 124 occurs, the system deactivates and returns to a pre-alarm state. Conversely, if the patient tries to get up with the care giver at their side, the care giver pushes the reset button 117 on the unit 110 to turn off the alarm and put the system 100 back to a dormant state. This cycle continues when the patient sits back down on object 130. As an alternative example (not shown), the care giver is provided with a device that is attachable to their garment with said device being able to emit a signal that is detectable by units 110 and 120 when the device is in close proximity. For example, 1-4 feet away. Whenever a patient 300 tries to get up without assistance, the system 100 produces an audible alarm as described herein above. If the patient 300 has a care giver with them, however, the system detects the device worn by the caregiver and automatically resets. This approach omits the need for the caregiver to press the reset button when it is not necessary.

Figure 13:
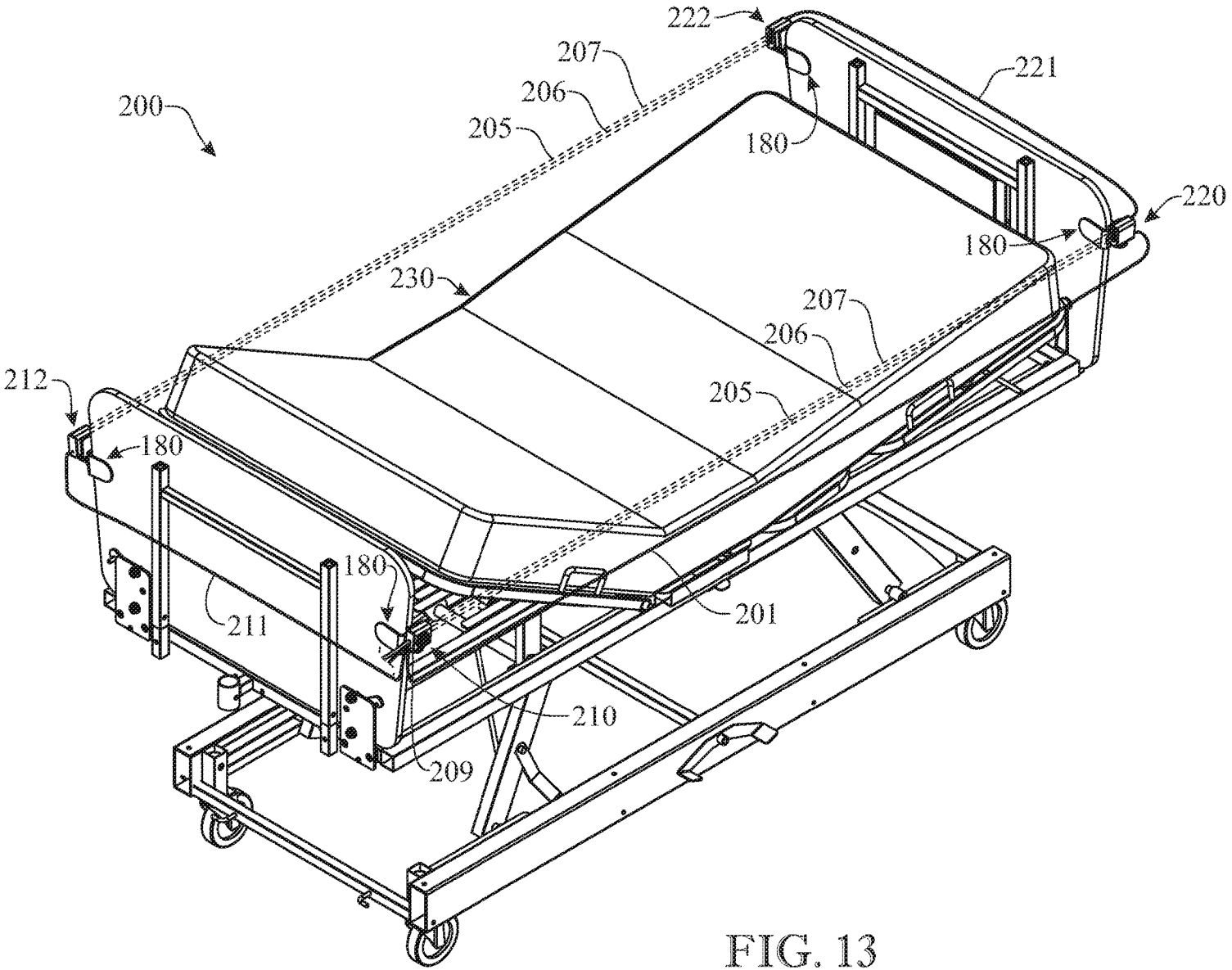
FIG. 13 presents a rear isometric view of the laser alert system originally shown in FIG. 1, being selectively mounted to a hospital bed at the foot and head of the bed.
Figure 14:
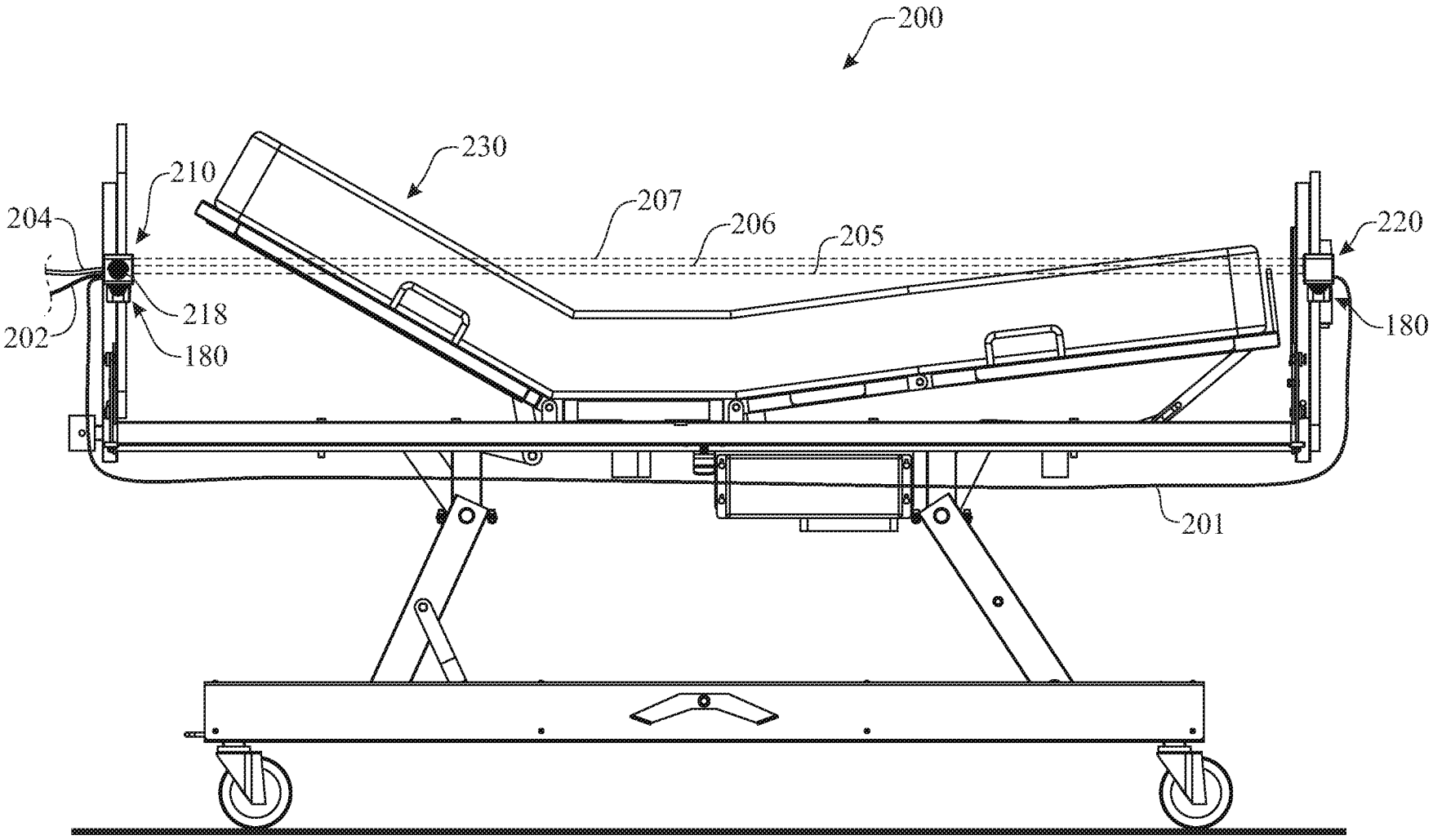
FIG. 14 presents a side view of the laser alert system selectively mounted to a hospital bed.

Turning now to FIGS. 12 and 13, in an alternative embodiment of the present invention, a system 200 is generally shown. It should be readily understood that system 100 and system 200 are fairly similar, and as such, like references are numbered the same with the prefix '2'. System 200 may generally include a first and second emitting units 210, 212, that are connected adjacent one another, and a first and second receiving units 220, 222 that are also connected adjacent one another. In this exemplary form of the present invention, the system 200 is meant to be attached to a movable object, such as, a bed having two sides. However, the system 200 (as well as system 100) may be selectively attached to other types of movable objects, such as wheel chairs or the like. As illustrated, unit 210 may include a power supply cord 204 that may be connected to a power supply, and include a communication cord 202 that is selectively attachable to an existing communication system (not shown). As stated above, emitting unit 210 may be connected to emitting unit 212, and receiving unit 220 may be connected to receiving unit 222. Each unit may be selective attached to the head and foot of a bed frame via mounting bracket, such as, the swivel U-mount 180 that was described herein above. For the sake of brevity, it should be readily understood that the principles of operation of system 200 are identical to the principles of operation of system 100 as was described heretofore. The only difference being that instead of one pair of units, two pairs of receiving and emitting units are utilized to monitor the patient from getting off the bed on either side. Giving the care giver confidence that they can step away from their patient and continue to provide care for others without having to worry about an accidental fall.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A laser monitoring system designed to prevent accidental falls, comprising:

a first unit, comprising
- a circuit board,
- a laser emitting device,
- a first alignment indicator,
- at least two control buttons,
- an alarm speaker,
- a connection line,
- at least one communication port,
- an electrical port for receiving an electrical connector to energize said first unit; and
- an electrical housing, said electrical housing having an internal space for retaining said circuit board, said laser emitting device, said first alignment indicator, said at least one control button, said at least one communication port, said electrical port, and said alarm speaker;

a second unit, comprising
- a circuit board;
- a laser receiving device;
- a second alignment indicator;
- at least one receiving port, said receiving port adapted to selectively receive said connection line provided by said first unit, said communication line energizing said second unit and linking said second unit to said first unit; and
- an electrical housing, said electrical housing having an internal space for retaining said circuit board, said laser receiving device, said second alignment indicator, and said at least one receiving port; and a universal mount affixed to said first unit and said second unit, said universal mount attachable to a mounting arm;

wherein said connection line is used to selectively link said first unit to said second unit, and wherein said first unit and said second unit are selectively linked to one another to provide a penetrable laser net alarm.

2. The laser monitoring system of claim 1, wherein said laser emitting device comprises, at least one alignment laser, at least one activation laser, and at least one alarm laser.

3. The laser monitoring system of claim 1, wherein said laser receiving device comprises, at least one laser alignment sensor, at least one laser activation sensor, and at least one laser alarm sensor.

4. The laser monitoring system of claim 1, wherein said laser receiving device of said second unit is adapted and configured to receive at least one laser signal being emitted from said laser emitting device of said first unit to form said penetrable laser net alarm.

5. The laser monitoring system of claim 4, wherein said first alignment indicator of said first unit includes at least one LED light that indicates proper alignment and improper alignment of said first unit with said second unit.

6. The laser monitoring system of claim 4, wherein said second alignment indicator of said second unit includes at least one LED light that indicates proper alignment and improper alignment of said second unit with said first unit.

7. The laser monitoring system of claim 4, wherein an audible alarm is played from said alarm speaker when said penetrable laser net alarm is interrupted and subsequently uninterrupted by an object.

8. The laser monitoring system of claim 7, wherein said audible alarm is a pre-recorded message of someone known requesting a patient to remain seated until help arrives.

9. The laser monitoring system of claim 1, wherein said mounting arm is attachable to a chair.

10. The laser monitoring system of claim 1, wherein said mounting arm is attachable to a commode.

11. The laser monitoring system of claim 1, wherein said mounting arm is attachable to a bed.

12. The laser monitoring system of claim 1, wherein one of the at least two control buttons is an On/Off switch, and the other one being a reset switch.

13. A laser monitoring system designed to prevent accidental falls, comprising:

a first unit, said first unit comprising, a circuit board;

a laser emitting device;

a first alignment indicator;

at least two control buttons;

an alarm speaker;

at least one communicator;

an electrical port for receiving an electrical connector to energize said first unit; and an electrical housing, said electrical housing having an internal space for retaining said circuit board, said laser emitting device, said first alignment indicator, said at least one control button, said at least one communicator, said electrical port, and said alarm speaker;

a second unit, said second unit comprising, a circuit board;

a laser receiving device;

a second alignment indicator;

at least one receiver, said receiver adapted to selectively receive a wireless signal provided by said at least one communicator of said first unit to link said second unit to said first unit;

an electrical port for receiving an electrical connector to energize said second unit; and an electrical housing, said electrical housing having an internal space for retaining said circuit board, said laser receiving device, said second alignment indicator, and said at least one receiver, and said electrical port wherein said first unit and said second unit are selectively linked to one another to provide a penetrable laser net alarm that includes at least one laser signal being emitted from said laser emitting device of said first unit and being received by said laser receiving device of said second unit; and a universal mount affixed to said first unit and said second unit, said universal mount attachable to a mounting arm that is removably attachable to an object.

14. The laser monitoring system of claim 13, wherein said second unit further comprises an internal timer to prevent false alarms when said at least one laser of said penetrable laser net alarm is accidently interrupted.

15. The laser monitoring system of claim 14, wherein an alarm is triggered when said at least one laser of said penetrable laser net is interrupted for about 3 to 5 seconds and subsequently uninterrupted by a person, said alarm including an audible alarm message played by said alarm speaker of said first unit requesting a patient to remain seated until help arrives.

16. A laser monitoring system designed to prevent accidental falls, comprising:

at least one first unit, said at least one first unit comprising, a circuit board;

a laser emitting device;

a first alignment indicator;

at least two control buttons;

an alarm speaker;

at least one communicator, said communicator communicable with at least one electronic device;

an electrical port for receiving an electrical connector to energize said first unit; and an electrical housing, said electrical housing having an internal space for retaining said circuit board, said laser emitting device, said first alignment indicator, said at least one control button, said at least one communicator, said electrical port, and said alarm speaker;

at least one second unit, said at least one second unit comprising, a circuit board;

a laser receiving device;

a second alignment indicator;

at least one receiver, said receiver communicable with said communicator of said first unit;

an electrical port for receiving an electrical connector to energize said second unit; and an electrical housing, said electrical housing having an internal space for retaining said circuit board, said laser receiving device, said second alignment indicator, and said at least one receiver, and said electrical port;

wherein at least one of said first unit and at least one of said second unit are selectively aligned and linked to one another to form a penetrable laser net that includes at least one laser signal being emitted from said laser emitting device of said first unit and being received by said laser receiving device of said second unit, such that when said at least one laser signal is interrupted and subsequently uninterrupted by a person an alarm is triggered, said alarm includes an audible message played by said alarm speaker requesting said person to remain still and wait for attention; and a universal mount affixed to said at least one first unit and said at least one second unit, said universal mount attachable to a mounting arm.

17. The laser monitoring system of claim 16, wherein said alarm includes a wireless message being transmitted via a wireless network to said electronic device notifying a care giver said person is about to get up.

18. The laser monitoring system of claim 16, wherein said mounting arm attached to said universal mount is removably attached to a bed.

* * * * *